US005349907A

United States Patent [19]

Petrovich et al.

[11] Patent Number: 5,349,907

[45] Date of Patent: Sep. 27, 1994

[54] HIGH VELOCITY PROJECTILE

[76] Inventors: Robert M. Petrovich, 10748 Bob White, P.O. Box 111, Hamburg, Mich. 48139; Paul A. Petrovich, 11269 Judd Rd., Fowlerville, Mich. 48836

[21] Appl. No.: 130,574

[22] Filed: Oct. 1, 1993

Related U.S. Application Data

[62] Division of Ser. No. 35,863, Mar. 23, 1993, abandoned.

[51] Int. Cl.[5] ..... F42B 12/06; F42B 12/34

[52] U.S. Cl. ..... 102/506; 102/510; 102/516; 102/518

[58] Field of Search ..... 102/502, 507, 508, 509, 102/510, 514, 515, 516, 517, 518, 519, 529, 524, 525, 506, 501

[56] References Cited

U.S. PATENT DOCUMENTS

| | | | |
|---|---|---|---|
| 1,094,395 | 4/1914 | Kampen | 102/510 |
| 1,112,413 | 9/1914 | Hoagland | 102/507 |
| 1,833,645 | 11/1931 | Hartz | 102/508 |
| 2,682,224 | 6/1954 | Braverman | 102/507 |
| 4,108,074 | 8/1978 | Billing, Jr. et al. | 102/529 |
| 4,776,279 | 10/1988 | Pejsa | 102/510 |
| 5,149,913 | 9/1992 | Arakaki | 102/509 |
| 5,185,495 | 2/1993 | Petrovich et al. | 102/510 |

FOREIGN PATENT DOCUMENTS

| | | | |
|---|---|---|---|
| 2662789 | 12/1991 | France | 102/529 |
| 4019 | 12/1894 | United Kingdom | 102/519 |

*Primary Examiner*—Harold J. Tudor

*Attorney, Agent, or Firm*—Peter A. Taucher; David L. Kuhn

[57] ABSTRACT

Disclosed is a projectile that has high velocity at short range. The projectile has a body of material that is lighter, more lubricous and more deformable than a partial jacket on the rearward portion of the projectile. The jacket defines an annular array of apertures on the outer diametrical surface of the jacket and the body has peripheral zones that extend into the apertures far enough to be flush with the outer diametrical surface. The peripheral zones not only provide a physical lock between the body and jacket but also lubricate the interface between the projectile and the gun barrel along which the projectile travels during firing of a gun. The apertures are configured to allow the body to erupt radially outward through the jacket's side wall and form a relatively wide, shallow dispersal pattern when the projectile impacts a target. An optional core within the plastic body enhances the body's radially outward dispersal upon the projectile's impact with a target.

12 Claims, 2 Drawing Sheets

HIGH VELOCITY PROJECTILE

GOVERNMENT USE

The invention described herein may be manufactured, used and licensed by or for the U.S. Government for governmental purposes without payment to us of any royalty thereon.

This application is a divisional of application Ser. No. 08/035,863 filed 23 Mar. 1993 now abandoned.

BACKGROUND AND SUMMARY

The invention described herein relates to projectiles for guns and more particularly relates to projectiles for small rifled firearms. Our projectile is intended for use at short range, where the target is at a distance of one hundred feet or less.

Our projectile is comprised of a relatively light, soft body partly covered by a relatively hard, dense jacket. The jacket defines a belt-like array of apertures on the cylindrical outer surface of the jacket and the body has peripheral zones that fit through the apertures far enough to be flush with the jacket's outer surface. The peripheral zones lock the body to the jacket and lubricate the interface between the projectile and a gun barrel in which the projectile travels. The apertures weaken the jacket along their belt-like array to allow the body to erupt radially outward through the jacket when the projectile hits a target.

An optional core within the body increases the body's radially outward dispersal when the projectile impacts a target. The core is disposed along a longitudinal axis of the projectile and is made of stronger material than the body. The core has a flat head in a forward region of the body and has a shank aft of the head, and there is a fluid filled chamber directly aft of the shank. When the body flattens upon the projectile's impact with a target, the head forces the flow of body material outward from the axis. Also upon impact, the shaft is driven into the fluid filled chamber and the fluid exerts radially outward force on the body to assist dispersal of the body.

DETAILED DESCRIPTION

Figure 1:
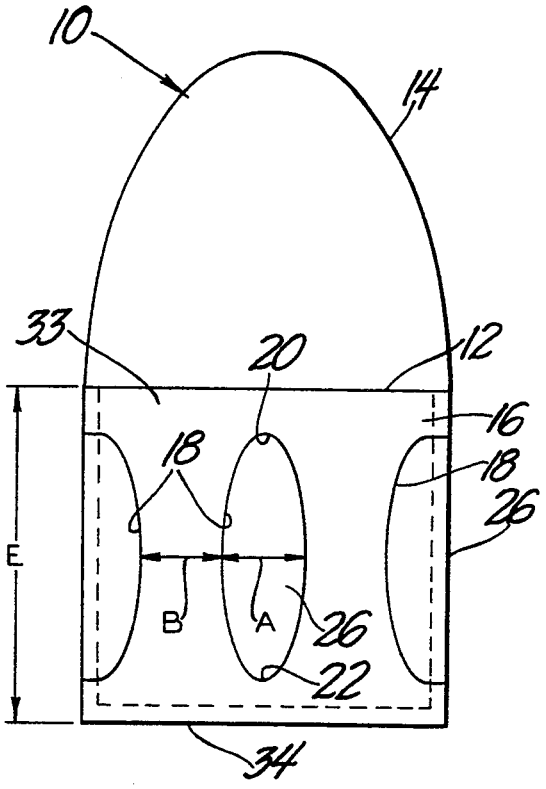
FIG. 1 is a side elevational view of a first embodiment of our improved high velocity projectile.
Figure 2:
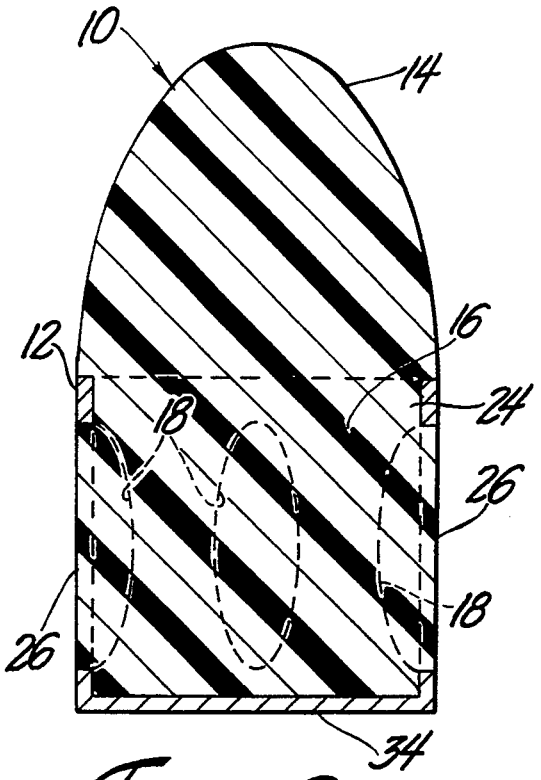
FIG. 2 is a longitudinal sectional view of the projectile shown in FIG. 1.

In FIG. 1 is shown a high velocity small arms projectile 10 whose jacket 12 partly covers a body made of plastic such as nylon or polytetraflouroethylene. The body can also be made of any other material that is less dense than and more easily deformable than the material of the jacket. The body is an integral unit comprised of a rounded frontal nose 14 and an anterior portion 16 adjacently behind the nose, the anterior portion being enclosed by jacket 12 behind nose 14. Jacket 12 is normally made of a soft metal such as mild steel, copper or brass, but can be made of any material which is equally or more malleable than these metals while being stronger and denser than the material of the body. Typically jacket 12 is a half jacket or three-quarters jacket covering a respective proportion of the plastic body and has an aft wall 34 completely covering the aft end of anterior portion 16. Aft wall 34 is normally integrally formed with the jacket but aft wall can also be a seperate element from the jacket, the aft wall being denser and stronger than the body. Jacket 12 defines a plurality of uniformly spaced apertures 18 and as seen in FIG. 2, anterior portion 16 fills apertures 18 so that its peripheral or outer surface areas 26 are flush with the outer surface of jacket 12. It can be seen that that anterior portion 16 physically locks with the jacket at apertures 18. Jacket 12 preferably defines four or five apertures 18 and these apertures are preferably elongated in along a fore-to-aft direction relative to the projectile as shown in FIGS. 1 and 2. It is also preferred that apertures 18 extend over the majority of the fore-to-aft dimension "E" of jacket 12 and that the fore end 20 and aft end 22 of the apertures be narrower than the aperture's minor diameter "A" midway between ends 20 and 22. It is also preferred that minor diameter "A" be at least as great as dimension "B" which is the minimum distance between apertures 18, and diameter "A" normally is larger than dimension "B". Apertures 18 are shown as ellipses in FIGS. 1 and 2, but apertures 18 may have other generally oval shapes or elongate diamond.

Figure 4:
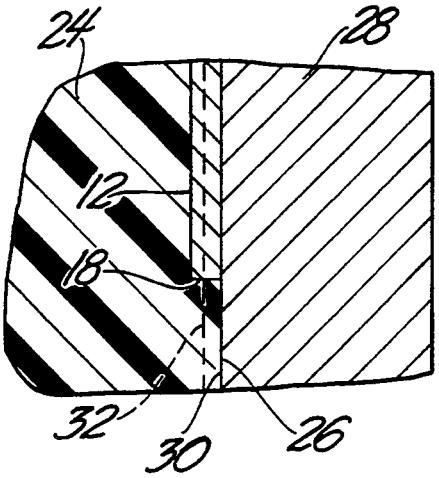
FIG. 4 shows a detail at an edge of a jacket aperture in the first embodiment of the projectile. A portion of a rifled gun barrel engaging the projectile is also shown.

FIG. 4 is a detail view of zone 24 (FIG. 2) of projectile 10 when zone 24 bears against a section of the inner diameter of a rifled gun barrel 28. The figure shows a short longitudinal section of the barrel's rifling groove where numeral 30 denotes the bottom of the groove and the barrel's land is at 32. As is conventional, it is intended that the inner diameter of barrel 28, which is defined by lands 32, will be slightly smaller than the outer diameter of jacket 12, whereby projectile is radially squeezed by the barrel. The radial squeezing tends to force surface area 26 radially outward from anterior portion 16 into bearing engagement with bottom 30 of the rifling groove and with land 32. Surface area 26 has greater lubricity than jacket 12 so that its bearing engagement with the groove and land eases the projectile's passage along the barrel and thereby increases projectile speed when the gun (not shown) is fired. As any given portion of surface area 26 rubs against the gun barrel, it leaves thereon a slight lubricating residue which eases passage of following, further aft portions of projectile 10. It is believed that the lubricating action will be most effective if surface area 26 is made of or is coated with nylon or polytetraflourethylene. The elongate shape of apertures 18 maximizes the size of the interface between the gun barrel and surface area 26 and consequently maximizes the lubricating effect of that surface area.

Since projectile 10 is comprised mainly of plastic or other relatively low density material, it will be lighter than metallic projectiles of similar volume and will have significantly greater speed than such metallic projectiles when exiting the barrel after the gun is fired. In most cases, projectile 10 will maintain its significant speed advantage for at least 100 feet, which is the intended range of the projectile. During initial penetration into a target, which is intended to be animal or human tissue, the plastic body of the projectile will flatten and radially expand. The radial expansion of the body will first break jacket 12 along a line around the jacket connecting apertures 18 at or near their minor radii "A". Then, while penetration into the target is still shallow, the body will erupt radially outward, carrying shards of the cylindrical side wall 33 (FIG. 1) of jacket 12 with it. In general, the eruption will be will be broader and shallower as dimension "B" is smaller. Apertures 18 will cause the cylindrical side wall 33 of jacket 12 to break before the integrity of aft wall 34 is affected. Since aft wall 34 is denser than the plastic body, wall 34 will tend to axially compress the plastic body against the target after impact begins, and will contribute to the body's radially outward momentum.

Figure 3:
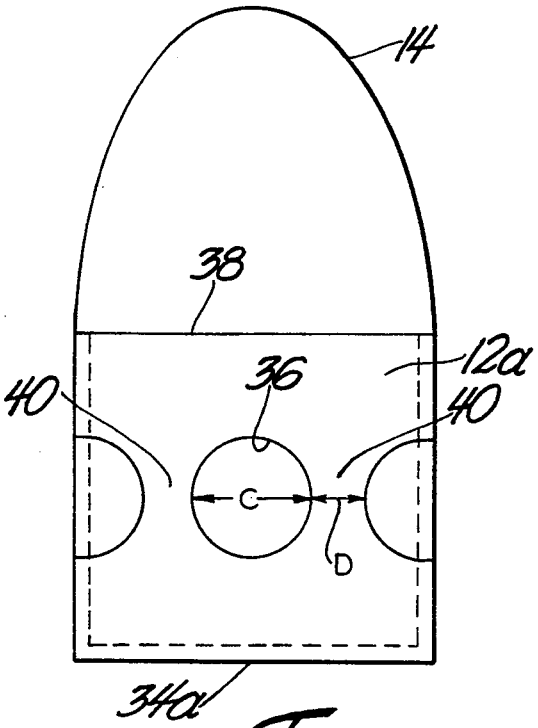
FIG. 3 is a side elevational view of an alternate embodiment of our projectile.

FIG. 3 shows an embodiment of our projectile that is in all respects the same as the FIG. 1 embodiment except that round apertures 36 in FIG. 2 replace elliptical apertures 18 in FIG. 1. Apertures 36 have a diameter "C" which preferably is two or more times as great as the distance "D" between the apertures. Apertures 36 are arranged in a circumferential array about jacket 12*a* and are typically disposed midway between forward edge 38 of the jacket and aft wall 34*a*. The distance "D" is preferably smaller either than the fore-to-aft distance between apertures 36 and forward edge 38 or the fore-to-aft distance between apertures 36 and aft wall 34*a*. "Distance D" is typically between one-third and two-thirds the size of either of these two fore-to-aft distances. The effect of keeping distance "D" smaller than diameter "C" and the aforementioned fore-to-aft distances is to insure that jacket 12*a* first breaks at necked zones 40 between apertures 36 when projectile 12*a* expands radially upon initial impact with target.

Figure 5:
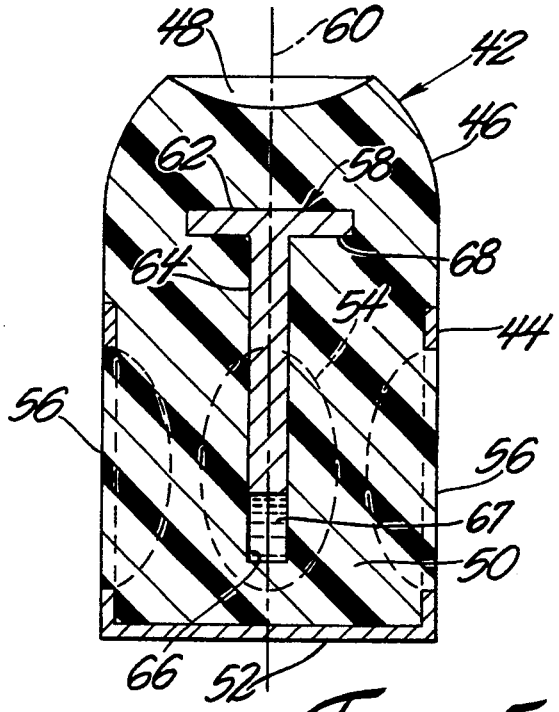
FIG. 5 is a cross sectional view of a second alternative embodiment of our projectile.

In FIG. 5 is shown another embodiment 42 of our high velocity small arms projectile having a jacket 44 in all respects similar to jacket 12 partly covering a body made of plastic such as nylon or polytetraflouroethylene. The fore end 46 of the body is disposed forward of jacket 44 and defines a dish shaped area or hollow point 48 at the nose of projectile 42. The plastic body has an posterior portion 50 integral with the fore end 46 and enclosed by jacket 44, the jacket having aft wall 52 completely covering the aft end of posterior portion 50. Jacket 44 defines a plurality of uniformly spaced oval apertures 54 that are similar to apertures 18 in FIG. 1. Posterior portion 50 fills apertures 54 such that outer surface areas 56 of portion 16 are flush with the outer surface of jacket 44 and so that posterior portion 50 physically locks with the jacket.

Projectile 42 has a core 58 embedded in the plastic body along central axis 60 of the projectile, the core being of stronger material than the plastic body. The forward end of core 58 has a disk shaped head 62 remote from hollow point 48 but still in fore end 46 of the body. Integrally attached to head 62 is an elongate shank 64 disposed along axis 60 behind disk 62, and a fluid filled chamber 66 is immediately behind the shank within posterior portion 50, the chamber being remote from wall 52. The fluid in chamber 66 can be a liquid 67 such as an oil or a gas such as air.

Projectile 42 will function the same as projectile 10 during impact with a target except for the effect of core 58 on the plastic body. This effect of core 58 will vary, depending on the specific gravity or density of the core relative to the plastic body. If the core has a specific gravity less than the specific gravity of the plastic body, then upon the projectile's impact with a target, the plastic body will tend to move forward relative to the core. A central zone of the plastic body behind head 62 will be squeezed against rear head surface 68 as the plastic body flattens. The material of the central zone will be forced radially outward by the head, whereby radial spreading of the plastic body during target impact is enhanced. Also, since the plastic body is moving forward relative to the core, cheer 66 is axially compressed, and the fluid therein will be forced radially outward. The fluid will in turn force the surrounding zone of the plastic body radially outward, thus further enhancing the radial spreading of the plastic body upon target impact.

If core 58 has a greater specific gravity than the plastic body, core 58 will tend at first to advance relative to the plastic body upon impact with the target so as to accelerate axial squeezing and radial spreading of the frontal portion of the plastic body between head 62 and hollow point 48. The rest of the body will impact the target a very short time later and create a secondary radially outward spreading of the projectile, the secondary spreading being similar to the target impact effect of the FIG. 1 embodiment of the projectile.

Figure 6:
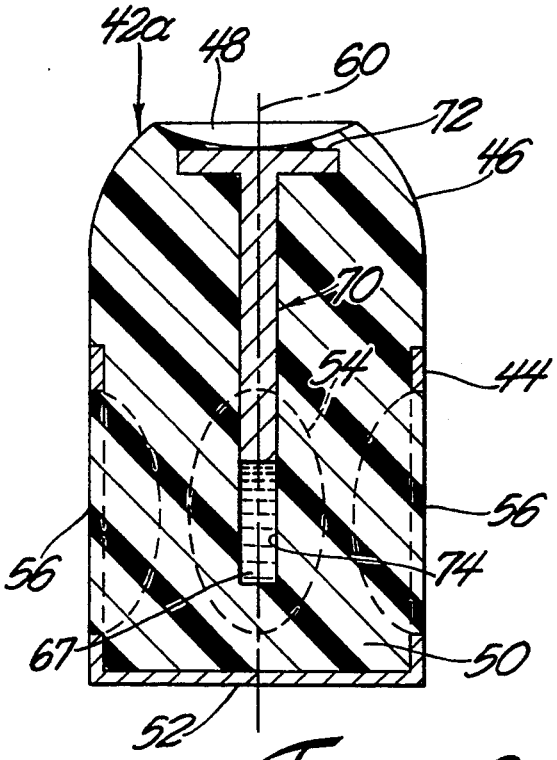
FIG. 6 is cross sectional view of a third alternative embodiment of our projectile.
Figure 7:
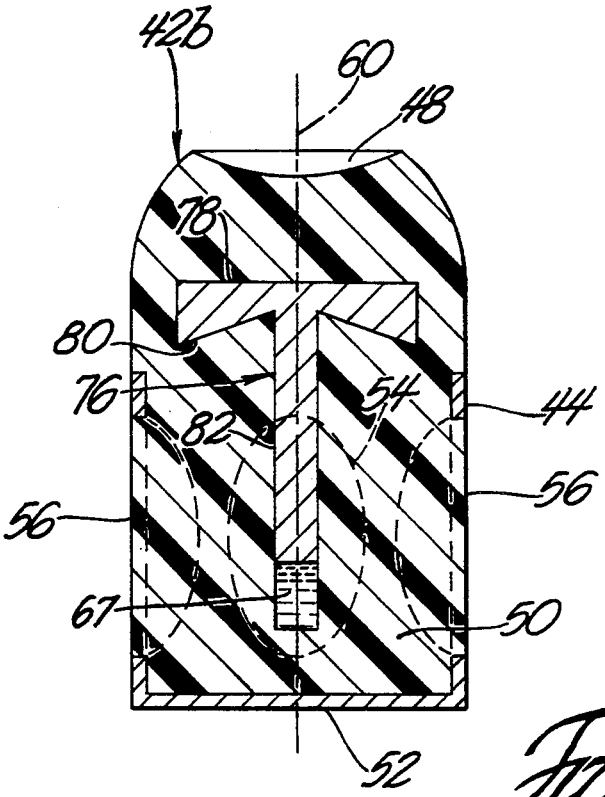
FIG. 7 is a cross sectional view of a fourth alternative embodiment of our projectile.

The FIG. 6 projectile 42*a* is the same as the FIG. 5 projectile, except that in FIG. 6, core 70 is moved further forward within the plastic body so that core head 72 is tangentially adjacent hollow point 48, and cheer 74 in FIG. 6 is longer than chamber 66 in FIG. 5. The FIG. 7 projectile 42*b* is the same as the FIG. 5 projectile except that in FIG. 7, core 76 has a rear surface 80 on head 78 which forms an acute angle with core stem 82.

We wish it to be understood that we do not desire to be limited to the exact details of construction shown and described herein since obvious modifications will occur to those skilled in the relevant arts without departing from the spirit and scope of the following claims.

We claim:

1. A projectile comprising:

a longitudinal axis;

a fore end;

an aft end;

a plastically deformable body defining a nose at the fore end and a posterior part at the aft end;

a jacket of denser and stronger material than the material of body surrounding the posterior part of the body;

the jacket defining apertures in an annular array around the jacket, the jacket sized diametrically in a vicinity of the array of apertures to be engraved by rifling of a gun barrel;

means for enhancing radial expansion upon target impact of the posterior part through the jacket at the array of apertures so as to accelerate jacket fragmentation;

the enhancing means including a core in the body along the longitudinal axis, the core formed of material stronger than the material of the body;

a flat, generally planar head of the core disposed in the nose of the body.

2. The projectile of claim 1 wherein peripheral portions of the posterior part are disposed within the apertures so as to form a physical lock between the body and the jacket, the peripheral portions having greater lubricity than the jacket.

3. The projectile of claim 1 wherein the core further includes:

a shank along the longitudinal axis behind the head;

a chamber defined in the body immediately behind the shank and sized to closely receive the shank;

liquid in the chamber.

4. The projectile of claim 3 wherein the material of the core is less dense than the material of the body.

5. The projectile of claim 3 wherein the material of the core is more dense than the material of the body.

6. The projectile of claim 3 wherein the head has an aft facing surface forming an acute angle with the shank.

7. The device of claim 1 wherein:

the nose defines a hollow point;

the flat head is a disk tangent to the hollow point.

8. A projectile comprising a fore end;

an aft end;

a body defining a nose at the fore end and having a posterior part at the aft end;

a jacket of denser and stronger material than material of the body and surrounding the posterior part of the body;

the jacket defining a plurality of apertures disposed in an annular array about the jacket, the jacket sized diametrically in a vicinity of the array of apertures to be engraved by rifling of a gun barrel;

means acting at target impact for enhancing jacket fragmentation by eruption of the posterior part radially through the array of apertures;

the enhancing means comprising an aft wall at the aft end, the aft wall being of material which is stronger and denser than the material of the body;

the enhancing means further comprising a flat, generally planar head in the nose, the head being formed of a material stronger than the material of the body, the head oriented generally parallel to the aft wall.

9. The projectile of claim 8 further comprising:

a shank extending from the head toward the aft wall;

a chamber defined in the body immediately adjacent the shank between the shank and the aft wall, the chamber sized to closely receive the shank;

liquid in the chamber.

10. A high speed short range projectile, comprising:

a longitudinal axis;

a fore end;

an aft end;

a plastically deformable body defining a nose at the fore end and having a posterior part at the aft end;

a jacket surrounding the posterior part, the jacket of denser and stronger material than material of the posterior part;

first means for enhancing jacket fragmentation by eruption of the posterior part radially through the jacket at target impact, the first means comprising apertures in an annular array around the jacket, the jacket sized diametrically in a vicinity of the array of apertures to be engraved by rifling of a gun barrel;

second means for enhancing jacket fragmentation by eruption of the posterior part through radially through the jacket at the array upon target impact, the second means comprising a core in the body disposed along the longitudinal axis, the core being of stronger material than material of the body;

a flat, generally planar head of the core disposed in the nose of the body.

11. The projectile of claim 10 wherein the second means includes an aft wall at the aft end of the projectile, the aft wall formed of a material denser than the material of the body.

12. The projectile of claim 11 wherein the second means further includes:

a shank extending from the head toward the aft wall;

a chamber in the body immediately axially adjacent the shank, the chamber sized to closely receive the shank;

liquid filling the chamber.

* * * * *